US009422941B2

(12) United States Patent
Nielsen et al.

(10) Patent No.: US 9,422,941 B2
(45) Date of Patent: Aug. 23, 2016

(54) IMPELLER FOR A PUMP AND CORE ARRANGEMENT AND METHOD FOR CASTING AN IMPELLER FOR A PUMP

(75) Inventors: Jon Ricky Nielsen, Viborg (DK); Christian A. Jørgensen, Viborg (DK)

(73) Assignee: Grundfos Management a/s, Bjerringbro (DK)

( * ) Notice: Subject to any disclaimer, the term of this patent is extended or adjusted under 35 U.S.C. 154(b) by 730 days.

(21) Appl. No.: 13/332,549

(22) Filed: Dec. 21, 2011

(65) Prior Publication Data

US 2012/0163980 A1 Jun. 28, 2012

(30) Foreign Application Priority Data

Dec. 23, 2010 (EP) ..... 10016065

(51) Int. Cl.
*B22C 9/10* (2006.01)
*F04D 29/02* (2006.01)

(52) U.S. Cl.
CPC ..... *F04D 29/026* (2013.01); *F05D 2230/21* (2013.01)

(58) Field of Classification Search
CPC ..... B22C 9/103; B22C 9/10; F04D 29/026
USPC ..... 164/6, 369, 370, 137; 249/184
See application file for complete search history.

(56) References Cited

U.S. PATENT DOCUMENTS 4,231,413 A * 11/1980 Bretzger ..... 164/15
2012/0124994 A1* 5/2012 Hommes et al. ..... 60/605.1

FOREIGN PATENT DOCUMENTS

JP 55-88954 A * 7/1980 ..... B22C 9/28
JP 56-68548 A * 6/1981 ..... B22C 9/22
JP 2007309193 A 11/2007
JP 2008303740 A 12/2008
WO 2007046565 A1 4/2007

OTHER PUBLICATIONS

Complete translation of JP 55-88954 A (Miyagawa et al.; Jul. 1980; originally cited in PTO-892 mailed Dec. 31, 2015).*
EP Search Report issued on Jun. 9, 2011 in EP Application No. 10 01 6065.
Office Action issued Jun. 8, 2015 in EP Application No. 10016065.4.

* cited by examiner

*Primary Examiner* — Kevin P Kerns
(74) *Attorney, Agent, or Firm* — Panitch Schwarze Belisario & Nadel LLP

(57) ABSTRACT

An impeller (2) for a pump is designed as a casting and includes at least one blade (4). The impeller (2), when casting, is molded by way of at least two core parts (14, 16). Partition lines (26, 28) between the at least two core parts (14, 16) are distanced to an end-edge (10) of the at least one blade. The end-edge is at a front in a flow direction (S).

5 Claims, 3 Drawing Sheets

IMPELLER FOR A PUMP AND CORE ARRANGEMENT AND METHOD FOR CASTING AN IMPELLER FOR A PUMP

BACKGROUND OF THE INVENTION

The present invention relates generally to an impeller for a pump having at least one blade and designed as a casting, as well as a core arrangement and to a method for casting such an impeller.

Impellers of pumps as a rule are either composed from sheet-metal parts or as castings of plastic or metal. On account of the shape of the flow channels in the impeller, cores are necessary when casting, in order to be able to form undercuts resulting due to the shape of the flow channels. Lost cores are often used with cast impellers of metal.

The cores are often designed in such a complex manner, that the inner contour which defines the negative mold for the impeller to be formed, may often not be completely viewed, to the extent that before casting, one may not recognize as to whether the core is in a perfect condition. Thereby, it is particularly problematic to form the entry region of the flow channels, for example, in particular the blade edge which is at the front in the flow direction, without faults.

It is therefore desirable when manufacturing the core, to be able to ensure that this region is formed in a perfect manner, in order to ensure a faultless shaping of the blade front edge. This is a region which is essential for the flow guidance, and it is particularly with self-priming pumps that this region is formed in a perfect manner, in order to be able to ensure the desired suction power.

BRIEF SUMMARY OF THE INVENTION

It is therefore an objective of a preferred embodiment of the present invention, to improve a cast impeller to the extent that a faultless formation of the entry region of the flow channels may be ensured in a simplified manner. Moreover, it is an objective of a preferred embodiment of the present invention to provide a corresponding core arrangement and a method for casting an impeller, with which it is possible to form the entry region of the flow channels in an improved quality.

The above objective is achieved by an impeller as disclosed and shown herein, by a core arrangement as disclosed and shown herein, as well as by a method with the features disclosed and shown herein. Preferred embodiments are to be deduced from the subsequent description as well as the attached figures.

The impeller according to a preferred embodiment of the present invention for a pump includes at least one blade and is designed as a casting. According to a preferred embodiment of the present invention, one envisages the impeller being molded by way of at least two put-together core parts when casting, wherein the partition line or partition lines between the two core parts is/are situated such that it or they are distanced to the end-edge of the at least one blade, the end-edge being at the front seen in the flow direction. For example, it is ensured that the partition lines or partition gaps, on which the at least two core parts are put together, are not situated in the region of the front end-edge of the blade which forms the entry region of the flow channel through the impeller. In this manner, one succeeds in this sensitive end-edge being formed in only one core part. Due to this, it is easier to ensure that this end-edge is formed in its predefined shape without faults, which for example could originate from contamination or damage in the region of the partition gaps of the cores. Due to the separation of the mold into at least two core parts, one may moreover ensure that the negative mold for the end-edge is situated in the corresponding core part, such that it may be seen from the outside before putting together the core parts. This then, before the casting of the impeller, allows one to check as to whether the negative mold for the front end-edge of the impeller is faultless.

Preferably, the at least one partition line between the at least two core parts, on a flow-leading front side of the at least one blade, is distanced further to the front end-edge than a partition line or partition gap between the two core parts on the rear side of the blade. The front side of the blade is thereby the flow-leading side which effects a flow deflection on operation. This is the region of the blade which must be formed in a particularly precise manner for leading the flow, in particular in the entry region close to the front end-edge of the blade, in order to be able to ensure the desired suction characteristics of an impeller. For this reason, it is desirable that possible shortcomings of the predefined blade shape, which originate from the partition gap between the core parts, are distanced in this region as far as possible from the front end-edge of the blade, in order to be able to form this sensitive blade region in as faultless as possible manner. The blade rear side is less sensitive, so that the partition gap or partition line may be situated closer to the front end-edge of the blade in this region.

Further preferably, the at least one partition line on a flow-leading front side of the at least one blade, in the flow direction is situated in the rear 70° of the blade length, preferably the rear half, further preferably the rear third of the blade, in order to ensure an adequate distance to the end-edge of the blade which is at the front seen in the flow direction.

Particularly preferably, the impeller is designed as a casting of metal. The molds or cores for such castings are usually formed amid the application of mold sand. For this reason, there is the problem that individual particles may break out of the mold or out of the core, in particular at the interfaces, at which the cores are put together. Moreover, there is also the danger that individual particles collect in inaccessible regions of the mold or of the core. By way of the design according to a preferred embodiment of the present invention, with which the partition plane or partition line for the cores is situated in a region of the impeller, in which shape deviations have a lesser influence on the leading of the flow, the danger of a negative influence on the impeller to be cast due to mold particles possibly detaching at the partition lines and geometry deviations of the cast impeller which this entails, is significantly reduced. Moreover, due to the partition of the core, one may succeed in the region forming the end-edge of the blade which is at the front in the flow direction, being able to be freely viewed, so that this region in particular may be controlled as to whether contamination or damage to the mold surface is present. As the case may be, these may then be corrected before the casting of the impeller or indeed the core may be rejected and replaced by another core.

The subject matter of a preferred embodiment of the present invention is furthermore a core arrangement for forming an impeller according to the preceding description. The core arrangement comprises at least two core parts, wherein the mold for at least one blade of the impeller in the core parts is designed in a manner such that the mold for the end-edge of the blade which is at the front in the flow direction is formed completely alone by one of the core parts. By way of this, as already described above, one succeeds in the partition line or the partition gap between the two core parts not being situated in the blade region which is at the front seen in the flow direction and with which region it is particularly important to have an exact geometry of the course of the blade. In particular, it is ensured that the front end-edge which should be designed as precisely and as accurately as possible, is not crossed or touched by a partition gap or partition line of the core. In this manner, one prevents geometry deviations or undesired burrs arising in this region.

Particularly preferably, the mold for the end-edge of the blade which is at the front in the flow direction is designed in the one core part in a manner such that it may be seen from the outside on the core part. As already described above, this has the advantage that this very important mold region may be exactly inspected before the casting and may be cleaned or corrected as the case may be, so that the casting of a faultless front blade edge without shape deviations, contamination or undesirable burrs may be ensured.

Further preferably, the partition line or the partition lines between the at least two core parts are situated in a mold section which defines the front and/or rear side of at least one blade of the impeller. The front and the rear side of the blade are thereby the sides which define or delimit a flow channel through the impeller. If the partition lines are situated in these regions, it is ensured that the partition line does not cross or touch the region of the blade front edge, for example, at the entry of the flow channel.

Further preferably, the partition line on the front side of the blade is distanced further to the end-edge of the blade which is at the front in the flow direction, than the partition line on the rear side of the blade. The front side of the blade is the side of the blade which achieves a flow deflection, for example, which is situated at the front in the rotation direction of the impeller. This as a rule is in particular a concavely curved surface, on which a flow is led or deflected. Thereby, in particular the region bordering the front blade edge is decisive for leading the flow. Due to the fact that the partition line between the core parts is relocated out of this region bordering the front end-side, one ensures that the impeller to be cast may be cast into this region which is decisive for leading the flow, in a manner which is as perfect as possible without burrs or damage to the surface.

Particularly preferably, the partition line is situated on the front side of the blade in the half which is at the rear in the flow direction, preferably in the rear third of the blade. In this manner, one may ensure that an as long as possible entry region may be cast on the front side of the blade in an optimal manner and with the best surface quality, without the partition gap between the core parts compromising the quality of the blade surface, for example, by way of burrs.

Further preferably, the core is designed as a lost core. For example, the core is designed such that it is destroyed after the casting of the impeller. In this manner, it is possible to form undercuts which prevent a removal of the core. The core is then removed by way of destruction. The production of the core or the core parts is particularly preferably effected by way of pressing or generating, wherein the core is formed from mold material in a layered manner. Thereby, the core or core parts may be produced with almost infinite shapes.

Furthermore, a preferred embodiment of the present invention relates to a method for casting an impeller of a pump according to the above description. With this method according to a preferred embodiment of the present invention, a casting mold is used, which has a core arrangement according to the preceding description. Thereby, the core arrangement includes at least two separately formed core parts which are put together after the molding, in order to form a larger mold part or the complete mold. The partition of the core has the advantage that the individual core parts may be formed in an improved and more precise manner and moreover the mold spaces or negative molds in the core, which later form the impeller blades, may be applied such that they may be completely viewed from the outside, in order to recognize damage or inaccuracies in the mold before the casting, and to be able to remedy them as the case may be.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
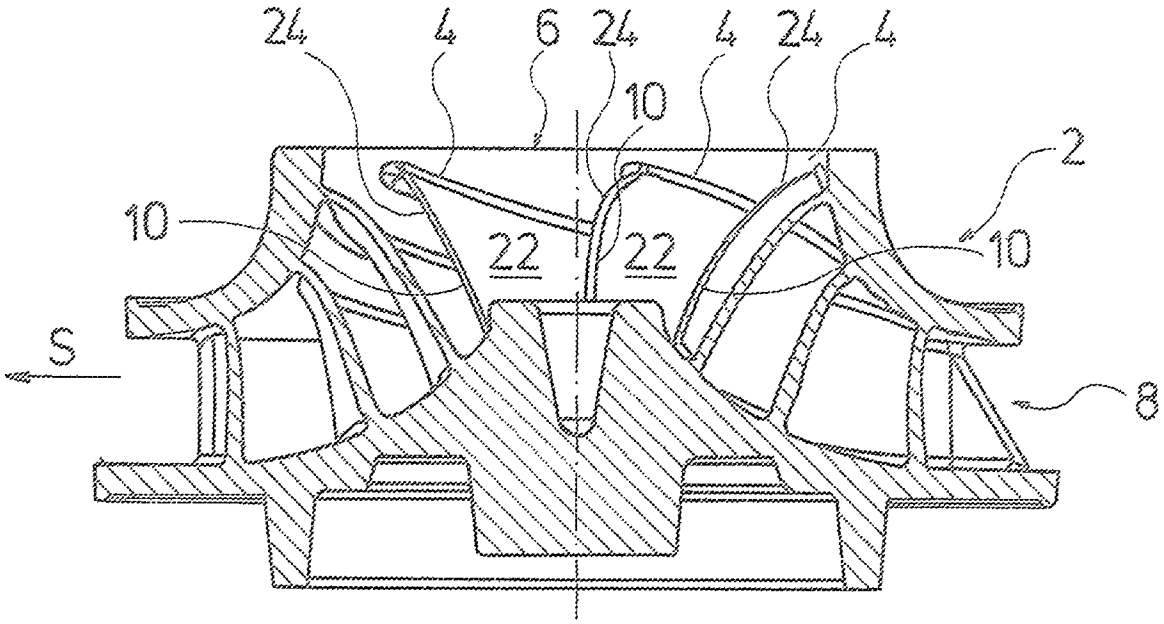
FIG. 1 is a cross-sectional view of an impeller for a pump assembly according to a preferred embodiment of the present invention.

Certain terminology is used in the following description for convenience only and is not limiting. The words "front" and "rear" designate directions in the drawings to which reference is made. The word "outwardly" refers to a direction away from the geometric center of the device, and designated parts thereof, in accordance with the present invention. Unless specifically set forth herein, the terms "a," "an" and "the" are not limited to one element, but instead should be read as meaning "at least one." The terminology includes the words noted above, derivatives thereof and words of similar import.

Referring to the drawings in detail, wherein like numerals indicate like elements throughout the several views, the impeller 2 shown in FIG. 1 includes several blades 4 which, departing from the suction port 6 of the impeller 2, extend in a curved manner to the outer periphery 8. In this manner, flow channels are formed between the blades 4 and these flow channels extend radially outwardly in an arched manner and are open to the outer periphery 8. Seen in the flow direction, the blades 4 include front end-edges 10 which are preferably situated on the flow entry facing the suction port 6. The flow direction thereby is the direction S, in which the flow runs between the blades 4 given a rotation of the impeller 2. These front end-edges 10 and the adjacent surfaces of the blades 6 must be formed in a particularly precise manner, in order to be able to ensure the desired delivery characteristic of the impeller 2, in particular suction characteristics of the impeller 2 and where possible should have a faultless surface. In order to achieve this, the impeller 2 is preferably designed as a casting, preferably of metal, amid the use of two core parts which are shown in FIG. 3.

Figure 3:
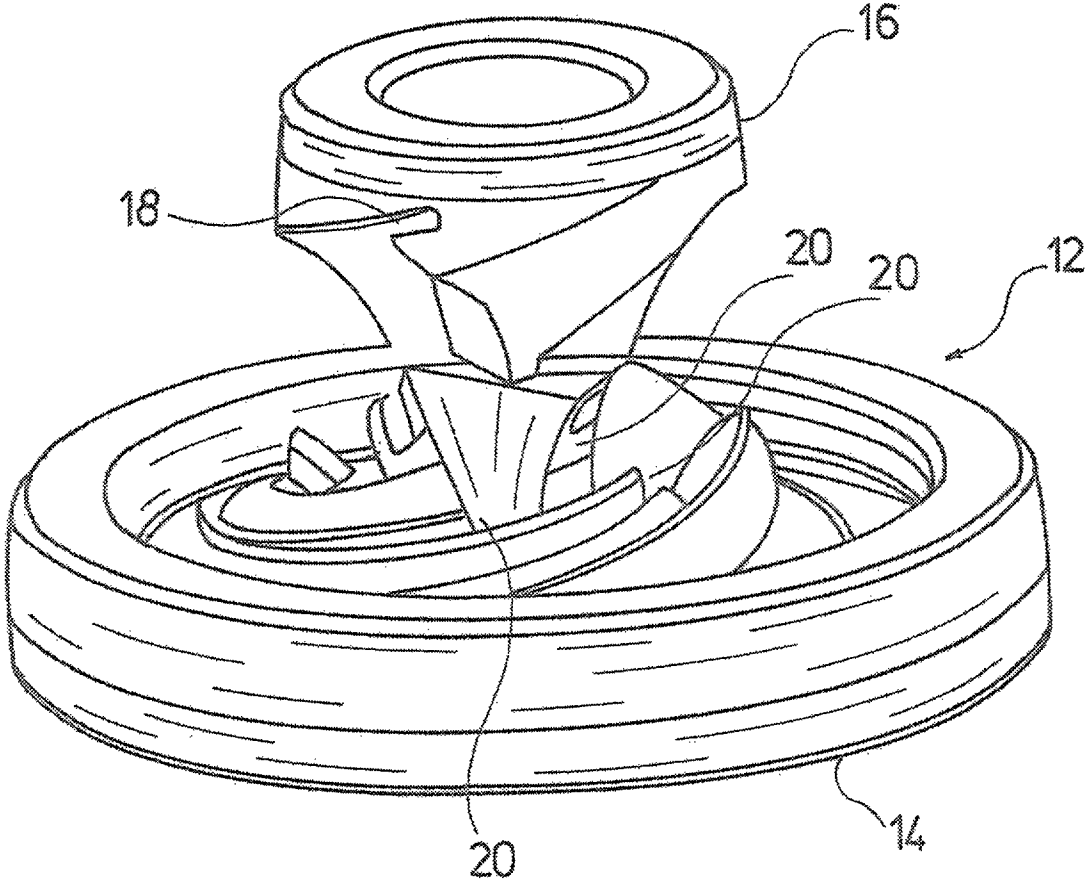
FIG. 3 is a perspective view of a core arrangement for forming the impeller according to FIGS. 1 and 2.

The core 12 shown in FIG. 3 forms a part of a casting mold for casting the impeller 2 and is preferably formed from two core parts 14, 16. Thereby, the core 12 is divided into the core parts 14, 16 such that the front end-edges 10 in their shape are completely defined by the core part 16. This preferably includes molds or mold regions 18 which represent the negative mold for the front end-edges 10 of the blades 4. Since these mold regions 18 which mold the front end-edge 10 are preferably situated completely in the core part 16, it is ensured that the partition gap 20 between the core parts 14, 16 indeed does not run in the region of this front end-edge 10 of the blades 4, so that the partition gap 20 which could cause burrs or surface inaccuracies on the cast piece, does not cross or touch the front end-edges 10. Moreover, the mold regions 18 are situated and arranged such that they may be completely seen from the outside, on the core part 16. This permits the molds or mold regions 18 which define the front end-edge 10 of the blades 4, to be inspected before putting together the core parts 14, 16, in order to be able to ascertain possible faults in the mold before the casting, and then either to be able to replace the mold part 16 or however be able to suitably rework the mold.

Figure 2:
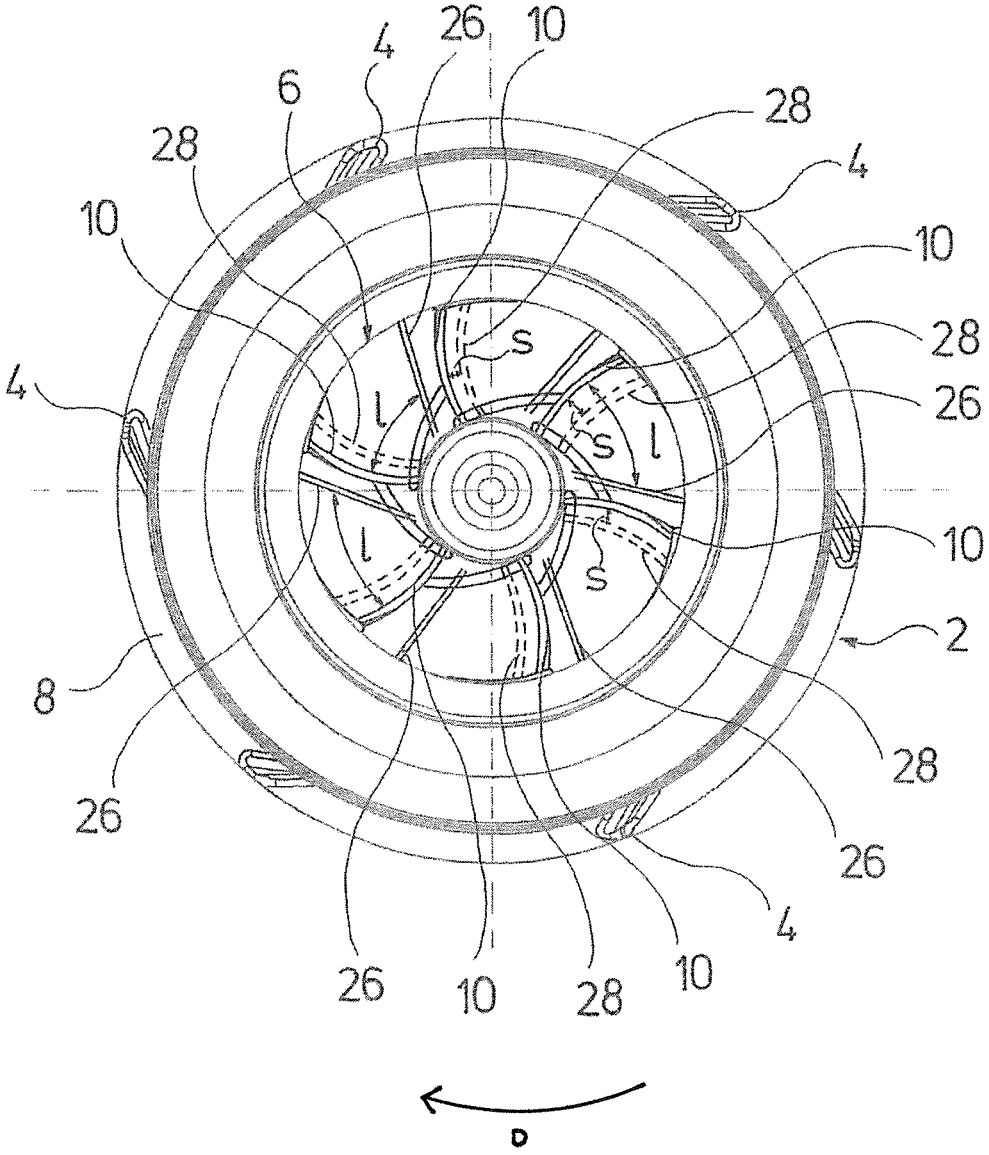
FIG. 2 is a plan view of the impeller according to FIG. 1.

Moreover, the partition gaps 20, on which the core parts 14, 16 are put together and come to bear on one another, are situated such that the partition lines on the blade front side 22 and the blade rear side 24 are distanced differently far from the front edge 10 of the blade. This is represented schematically in FIG. 2. The blade front side 22 is thereby the side of the impeller which is at the front in the rotational direction D. In FIG. 2, the course of the partition gap or the partition line 26 on the blade front side 22 is represented schematically as an unbroken line and the partition gap course or the partition line 28 on the blade rear side 24 is represented schematically as a dashed line. Thereby, one may recognize that the partition line 26 on the blade front side is distanced in the flow direction by an amount 1, whilst the partition line 28 on the blade rear side is distance 1 by an amount s in the flow direction S, to the front end-edge 10 of the blade. Thereby, the distance 1 is greater than the distance s. The blade front side 22 represents the flow-leading side of the blades 4. Inasmuch as this is concerned, the design of the surface of the front blade side 22, in particular in the region which is adjacent to the front end-edges 10, is of decisive importance, in order to achieve and optimal guidance of the flow in the impeller 2. For this reason, here it is envisaged to distance the partition line 26 in this region by the amount 1 further from the front end-edge 10. The blade rear side 24 has less flow-guiding functions. For this reason, the partition line 28 may run closer adjacently to the front end edge 10 in this region, since possible slight imperfections of the surface quality is less of a problem in this region of the blade rear side.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A core arrangement for casting an impeller (2) having a central suction port (6) and at least one blade (4) extending from the central suction port (6) to an outer periphery (8) of the impeller the at least one blade (4) having a front side 22 in a rotational direction of the impeller, an opposing rear side (24) and a radially innermost front end-edge (10) facing the suction port (6), the core arrangement comprising:

at least two individual core parts (14, 16) bearing against one another to cast the impeller, one core part (16) of the at least two core parts (14, 16) comprising a negative mold (18) which molds the front end-edge (10) of the at least one blade (4), such that the front end-edge (10) is formed completely by the one core part (16); and wherein the two core parts (14, 16) define a first partition line (26) where the two core parts (14, 16) bear against one another on the front side of the at least one blade (4) and define a second partition line (28) where the two core parts (14, 16) bear against one another on the rear side of the at least one blade (4), the first partition line (26) being further distanced from the front end-edge (10) than the second partition line (28).

2. The core arrangement according to claim 1, wherein the negative mold (18) is visible from outside of the core part (16).

3. The core arrangement according to claim 1, wherein the first partition line (26) on the front side (22) of the at least one blade (4) is distanced rearwardly from the front end-edge (10), in the flow direction (S), beyond a midpoint of the at least one blade (4).

4. The core arrangement according to claim 1, wherein at least one of the core parts (14, 16) is designed as a lost core.

5. A method for casting an impeller from a core arrangement having at least two individual core parts (14, 16), and wherein the impeller includes a central suction port (6) and at least one blade (4) extending from the central suction port (6) to an outer periphery (8) of the impeller, the at least one blade (4) having a front side (22) in a rotational direction of the impeller, an opposing rear side (24) and a radially innermost front end-edge (10) facing the suction port (6), the method comprising:

separately forming the at least two core parts (14, 16), wherein one core part (16) of the at least two core parts (14, 16) comprises a negative mold (18) to mold the front end-edge (10) of the at least one blade (4), such that the front end-edge (10) is formed completely by the one core part (16); and putting the at least two core parts together, such that the two core parts (14, 16) define a first partition line (26) where the two core parts (14, 16) bear against one another on the front side of the at least one blade (4) and define a second partition line (28) where the two core parts (14, 16) bear against one another on the rear side of the at least one blade (4), the first partition line (26) being further distanced from the front end-edge (10) than the second partition line (28).

* * * * *